United States Patent [19]

Piotrowski

[11] Patent Number: 4,501,107

[45] Date of Patent: Feb. 26, 1985

[54] BATT STACKER AND LOADER AND METHOD THEREFOR

[75] Inventor: Tony S. Piotrowski, Prairie Village, Kans.

[73] Assignee: CertainTeed Corporation, Valley Forge, Pa.

[21] Appl. No.: 454,422

[22] Filed: Dec. 29, 1982

[51] Int. Cl.[3] ..... B65B 1/24

[52] U.S. Cl. ..... 53/438; 53/529; 53/541; 100/215; 100/218

[58] Field of Search ..... 53/438, 436, 523, 528, 53/529, 530, 541; 100/215, 218

[56] References Cited

U.S. PATENT DOCUMENTS

| | | | |
|---|---|---|---|
| 1,673,014 | 6/1923 | Morrison . | |
| 2,744,369 | 5/1956 | Seragnoli . | |
| 2,768,489 | 10/1956 | Brown et al. . | |
| 2,869,296 | 1/1959 | Overman . | |
| 2,869,297 | 1/1959 | Neer . | |
| 2,885,097 | 5/1959 | Lyon . | |
| 3,442,400 | 5/1969 | Roth et al. . | |
| 3,475,877 | 11/1969 | Fuller et al. | 53/447 |
| 3,585,925 | 6/1971 | Fox | 100/218 |
| 3,818,673 | 6/1974 | Rollins et al. | 53/529 |
| 3,824,759 | 7/1974 | Finn et al. | 53/541 |
| 3,908,539 | 9/1975 | O'Brien | 100/218 |
| 3,977,155 | 8/1976 | Spaulding | 53/541 |
| 4,094,130 | 6/1978 | Kelly et al. | 53/529 |
| 4,099,363 | 7/1978 | Wistinghausen et al. | 53/524 |

FOREIGN PATENT DOCUMENTS

| | | |
|---|---|---|
| 213338 | 2/1961 | Austria . |
| 1573293 | 7/1969 | France . |
| 7220758 | 3/1972 | Netherlands . |

*Primary Examiner*—W. D. Bray

*Attorney, Agent, or Firm*—Paul & Paul

[57] ABSTRACT

An improved apparatus for collecting and stacking insulation batts or other similar articles and transferring these collections into one of a plurality of packing or compression chambers. The apparatus has a batt-transfer device that operates in a horizontal reciprocating motion, moving a first collection of batts from a collecting surface to a position in a packing chamber located on either side of the collection surface, and cycling back for another collection. Lifting members in each chamber raise the stack up to a predetermined height and holding fingers are inserted underneath this collection to hold them in place. The lifting members then cycle back down to the floor or bottom of the chamber for successive loads with the holding fingers being alternately extended and retracted in sequence to retain the successively larger collection of batts. When one chamber is completely full and a compression plate begins to force all the batts into a smaller unit, the reciprocating batt-transfer device starts transferring insulation batts into another packing chamber on the opposite side of the collection surface. After the compression plate forces the batts into a smaller, more compact unit, a ram pushes this unit through a snout and into a waiting container.

17 Claims, 24 Drawing Figures

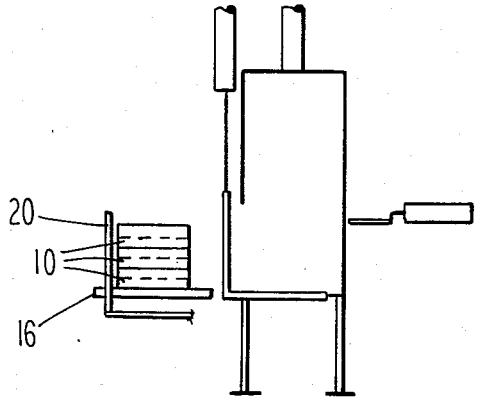
Fig. 6g
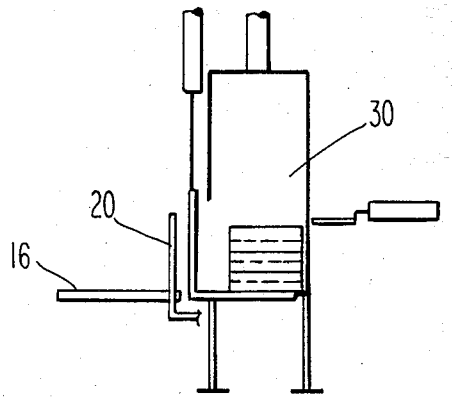
Fig. 6h
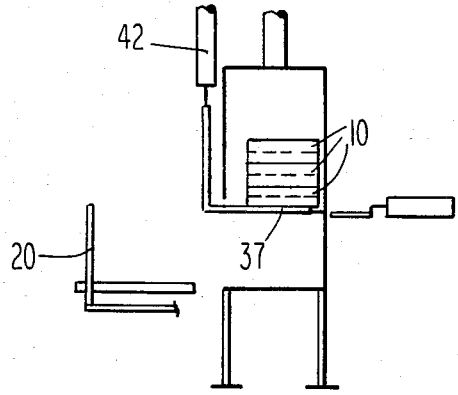
Fig. 6i
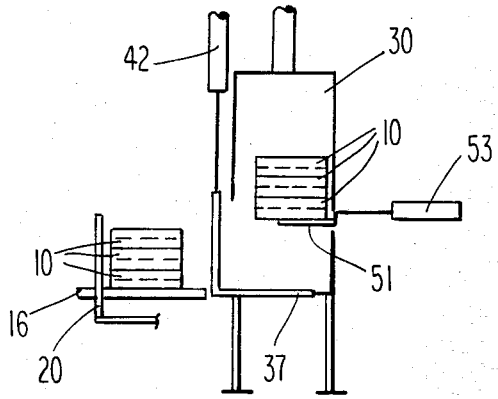
Fig. 6j
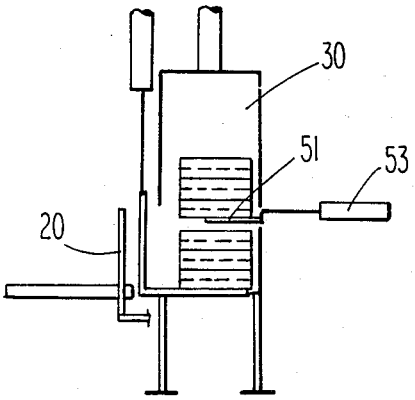
Fig. 6k
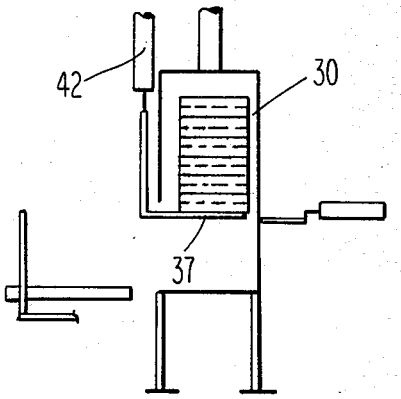
Fig. 6ℓ

BATT STACKER AND LOADER AND METHOD THEREFOR

BACKGROUND OF THE INVENTION

This invention is used for loading and packaging articles; more particularly, insulation batts or other similar type materials that proceed off an output conveyor of a production line.

One of the problems that occurs in the industry that produces insulation batts is the inability to be able to handle a great quantity of the insulation batts without employing a tremendous amount of physical space or without using individual labor at many points on the line. The present invention remedies both of these problems by automatically collecting and stacking the insulation batts as they proceed off a production line, moving the collection of batts into a compression chamber, compressing the batts and moving this compressed unit into a container. This improved apparatus can accomplish all of these jobs while the production line is moving at full speed and without the manual effort of individual laborers. This improved apparatus is also capable of being automatically adjusted so that if the thickness of the insulation batt is changed, the production line can still continue to operate at full speed.

An apparatus for handling insulation batts was disclosed in U.S. Pat. No. 3,824,759. This apparatus was a semi-automatic, batt-handling machine that addressed the problem of handling multiple insulation batts by allowing the compression machine to handle two adjacent stacks at once. This invention had batt compressing members for successively compressing these two adjacent stacks. This invention required at least one operator to collect the batts from the production line conveyor and deposit them in the twin stacks for the compression members.

Another apparatus for handling insulation batts was disclosed in U.S. Pat. No. 4,094,130. This apparatus utilized a sliding tray to move a first collection of batts forward into a bagging chamber. A second collection was sent into the chamber after the first collection was lifted up out of the way. Both of these collections are then compressed into a compact unit.

SUMMARY OF THE INVENTION

The instant invention improves upon the above described inventions by providing a plurality of packing chambers and a reciprocating transfer device to handle as many stacks of insulation batts as are produced from the production line. The batt transfer device of the present invention receives a stack of insulation batts preferably from a novel one or two-stage collection tray (also forming part of the present invention), and transfers the stack of insulation batts off of the collection and stacking surface into one of the packing chambers. The transfer device can push batts off that surface, laterally, from either direction. In addition, the present invention employs lifting members inside the packing chamber that raise a collection of batts to a higher level and holding fingers that are then inserted underneath this collection to allow the lifting members to cycle back down to the chamber floor. At this point another collection or stack of batts is pushed into the packing chamber on top of the lifting members, and these are then cycled up to the higher position. The holding fingers are withdrawn and reinserted underneath this second collection of batts. The lifting members are then cycled back down to their lower position and successive collections of batts are raised up into the chamber, while each time the holding fingers are inserted under the load to retain it at the higher position. When a predetermined number of stacks are accumulated in the chamber, the holding fingers are withdrawn and a compression plate is forced down from the top of the chamber to compress all of the batts against the chamber floor into a smaller unit. Simultaneously, while this is happening the batt transfer device is starting the same cycle of operations into another packing chamber. Once the unit is compressed, and while the plate is still holding all batts together, a ram moves from the back of the chamber through the chamber and pushes the unit into a container waiting on a snout.

Accordingly, it is an object of this invention to provide an automatic apparatus and process for packaging insulation batts which collects the batts into stacks, combines several stacks, compresses the combination into a unit, and moves the compressed unit into a container.

Another object of this invention is to provide an automatic apparatus and process for packaging insulation batts that receives all batts coming off a production line without jamming or allowing misplacement of a batt.

A further object of this invention is to provide an automatic apparatus and process for packaging insulation batts that is adjustable to handle batts of different thicknesses and different sizes.

Another object of the present invention is to provide a novel one or two-stage collection device for receiving relatively light insulation batts from a conveyor and collecting them one on top of the other without undesirable starting unevenness.

A still further object of this invention is to provide an apparatus and process wherein a single transfer device can alternately feed to a plurality of packing chambers.

A still further object of this invention is to provide a retaining means inside each chamber for holding successive collections of batts while other collections are accumulated therein.

Other objects and advantages of the present invention will be readily apparent to those skilled in the art by reading the following brief descriptions of the drawings, detailed description of the preferred embodiment, and the appended claims.

DESCRIPTION OF THE PREFERRED EMBODIMENT

Figure 1:
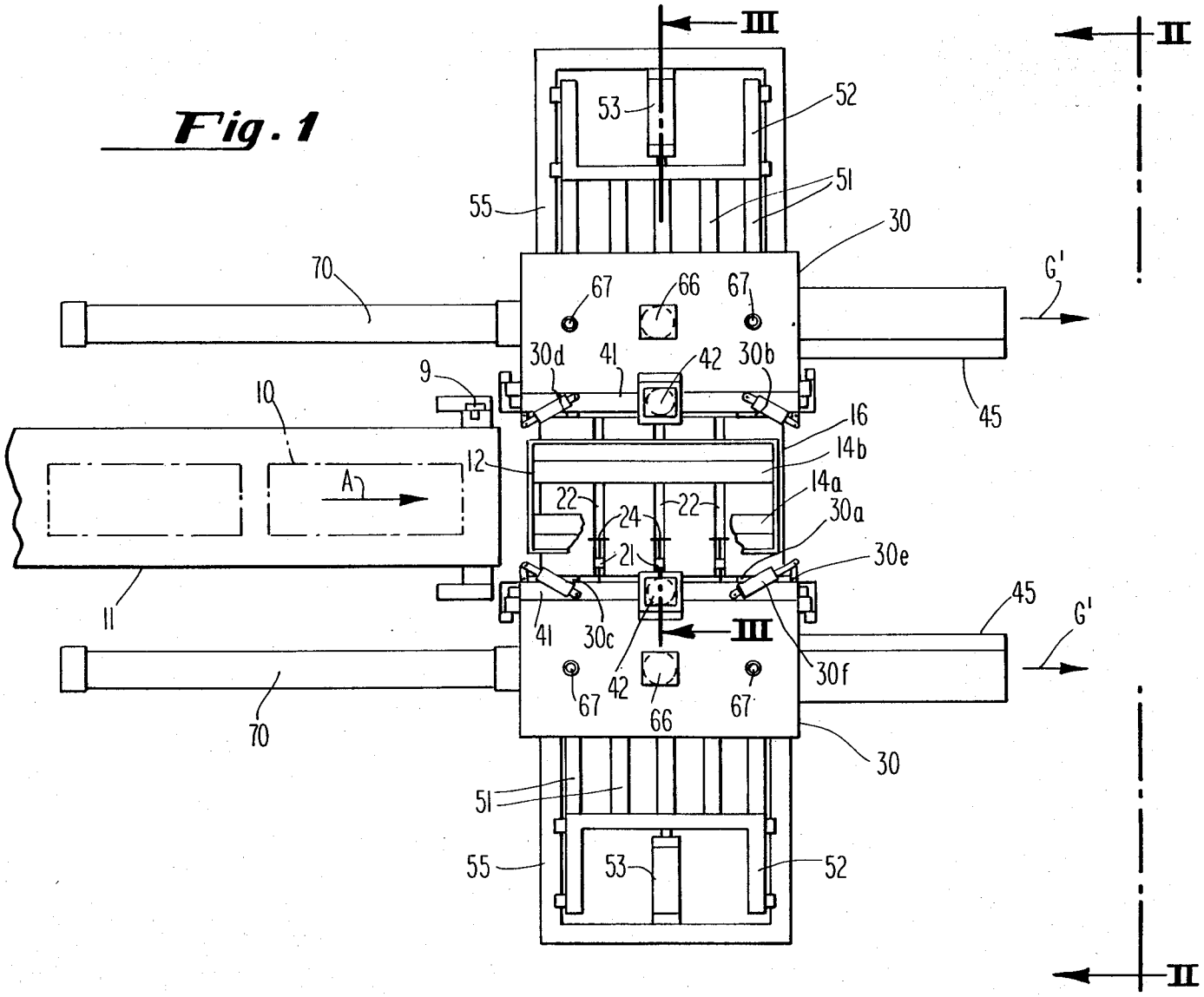
FIG. 1 is a plan view of the automatic packaging module apparatus according to the present invention.
Figure 2:
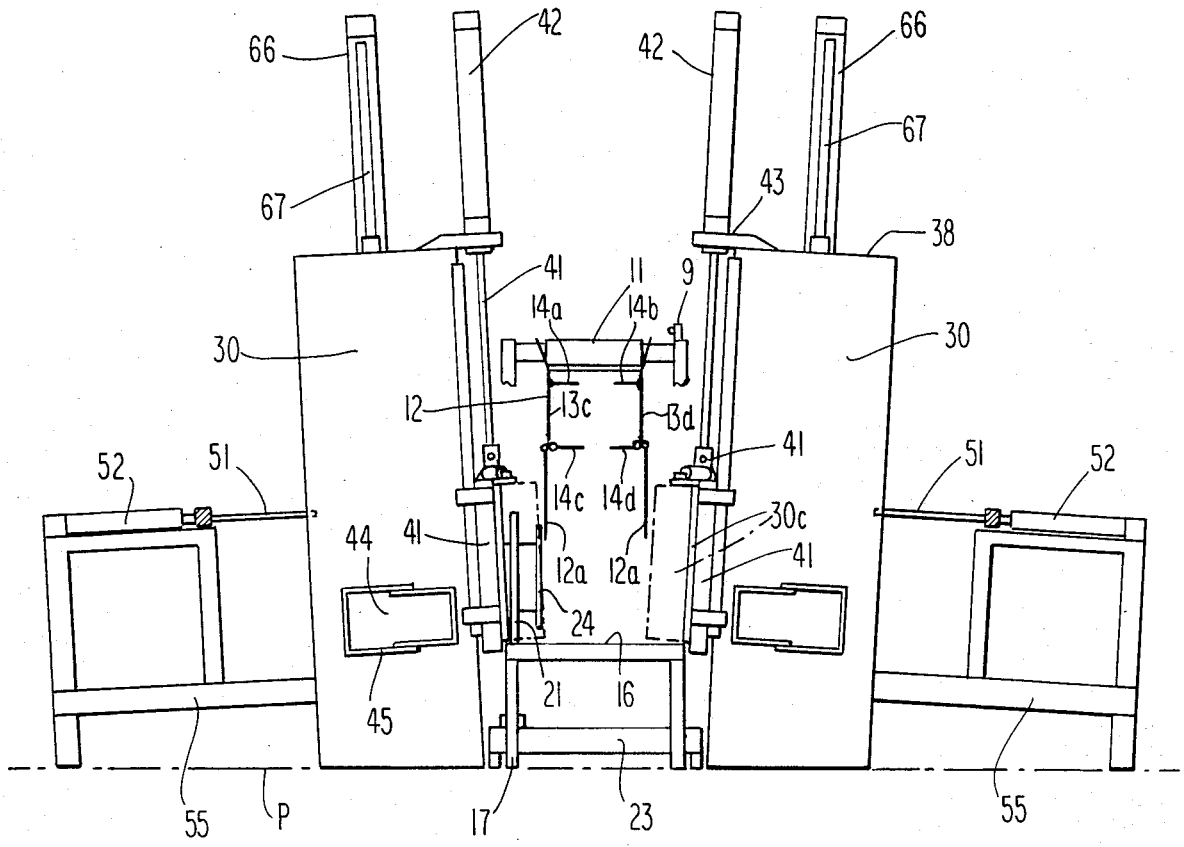
FIG. 2 is a front elevation view of the apparatus of FIG. 1.
Figure 3:
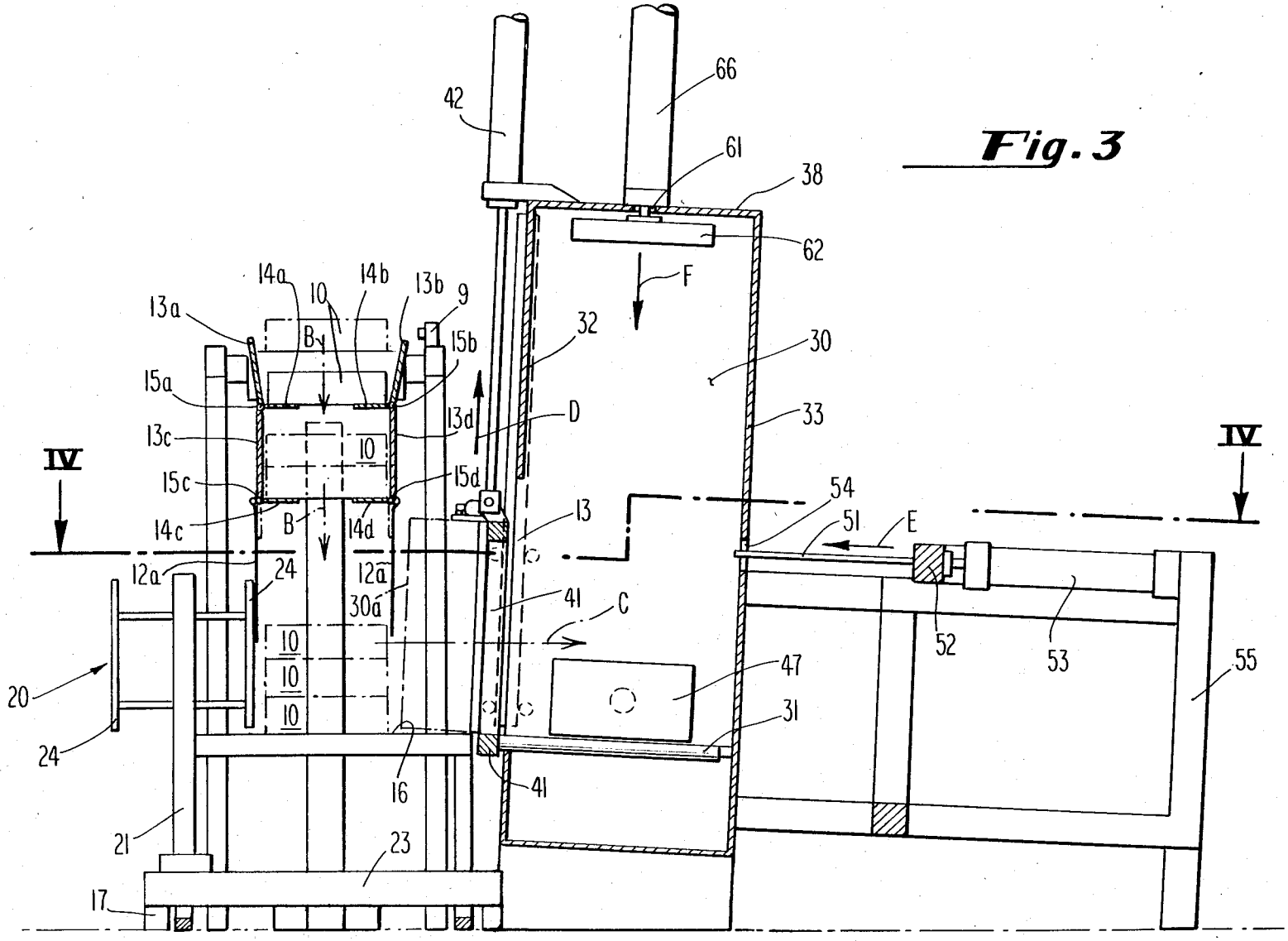
FIG. 3 is a sectional view taken along lines III—III of FIG. 1, with only a single chamber of the two chamber module being illustrated.

As seen in FIGS. 1 and 2 the apparatus of the present invention is positioned directly underneath the conveyor 11 of a production line to receive insulation batts 10 proceeding in the direction of Arrow A. A two-step collection tray or device 12 can be placed directly under the end of conveyor 11 to catch insulation batts 10 as shown by Arrow B, and a photo-cell counter 9 records each batt 10 as it passes. The counting of batts by counter 9 is recorded and the numbers used to activate other parts of the invention as will be explained further below. Tray 12 has a pair of sides 13*a* and 13*b* in a spaced relationship that extend down from a point adjacent the end of conveyor 11 to a first pair of trap doors 14*a* and 14*b*. Sides 13*a* and 13*b* are of sufficient distance apart and of sufficient length to allow one or more batts 10 to collect on doors 14*a* and 14*b*, as shown in FIG. 3. Batts 10 may be of a single thickness and predetermined length, or, alternatively, of a double or multi-thickness by folding and refolding to become of a predetermined length. First doors 14*a* and 14*b* are rotatable about a pair of hinges 15*a* and 15*b*, respectively, to first hold one or more batts 10 while in the horizontal mode and then upon a predetermined signal, subsequently release batts 10 by swinging down 90 degrees about hinges 15*a* and 15*b*, into a vertical mode. The batt or batts 10 then drop onto lower horizontally disposed but pivotal doors 14*c* and 14*d*, where two or more are collected. Then, second doors 14*c* and 14*d* are rotated to the horizontal position shown in phantom in FIG. 3, about hinges 15*c* and 15*d*, allowing the batts 10 to drop vertically onto a first surface 16, as shown by Arrow B. This two-step collection tray is especially helpful in allowing a folded batt to first be received by the tray formed by the upper doors 14*a* and 14*b*, without unfolding, and then to be dropped onto the tray formed by the doors 14*c* and 14*d*, and facilitates a neat, even stacking on the doors 14*c* and 14*d*, for proper registration of the batts one upon the other. A plurality of semi-flexible hanging straps 12*a* of plastic construction, hang from tray walls 13*c* and 13*d*, and assist continued proper stacking registration of the batts as they drop onto first surface 16. When unfolded batts are to be collected, it is sufficient to use a single stage collection tray, with only a simple set of doors 14*a*, 14*b*, and without a tray such as is formed by doors 14*c* and 14*d*. At a predesignated time and after a preselected signal from the controller (not shown), a batt transfer device 20, to be described in detail later, moves horizontally from one side to the opposite side, and in so doing transfers the collection or stack of insulation batts from first surface 16, and then returns to the original position in a laterally reciprocating motion. Surface 16 is a generally horizontally extending plate resting on a fixed structure 17.

The purpose of batt transfer device 20 is to transfer to either lateral side of first surface 16 a collection of insulation batts 10. The insulation batts are swept into one of a plurality of packing chambers 30, as shown by Arrow C (FIG. 3). As can be seen in FIGS. 1 and 2, packing chambers 30 are provided at opposite lateral sides of first surface 16. Batt transfer device 20 is comprised of vertical guides 21 which extend from above first surface 16 to below first surface 16 and are connected to a transfer power source 23. Power source 23 can be any one of a variety of types of moving cylinders as are known in the art, for example a hydraulic cylinder means, a pneumatic cylinder means, or an electrically driven rod means and is carried by structure 17. The vertical guides 21 move laterally in slots 22 in first surface 16. Guides 21 have a plurality of batt contacting fenders 24 attached at a predetermined point above surface 16 to opposite lateral sides of guides 21. Batt contacting fenders 24 actually make contact with the collection of insulation batts 10 on first surface 16 after a predetermined number of batts 10 stack up (as shown in phantom in FIG. 3 at 10). Batt transfer device 20, upon actuation by a suitable batt counter or batt weight control device or alternative (not shown), will reciprocatingly move first rightward from its position illustrated in FIG. 3 to transfer the stack of batts 10 in the direction Arrow C, and then leftward back to its original position as shown in FIG. 3, across surface 16, as guides 21 move in slots 22, thereby transferring the stack into a given packing chamber 30.

Figure 4:
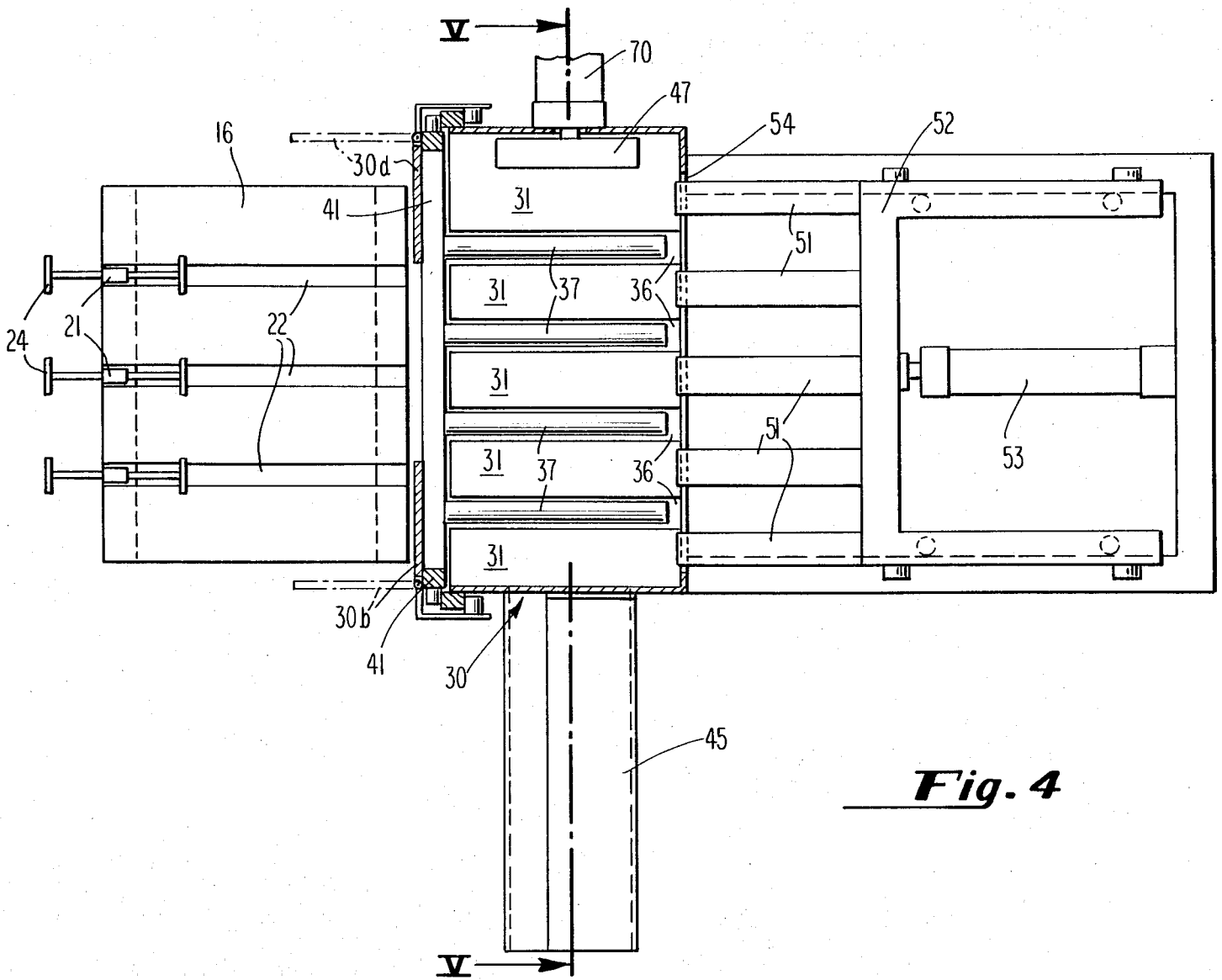
FIG. 4 is a sectional view taken along lines IV—IV of FIG. 3.

FIG. 2 is an elevational view of a plurality of packaging chambers 30 straddling the output conveyor 11 of the production line and immediately adjacent first surface 16. Chambers 30 are generally vertical structures (shown slightly canted in FIG. 2) to facilitate keeping an unstable stack of insulation batts disposed therein from falling out the open inlet 13 (shown in FIG. 3) made of a substantially rigid and strong material to withstand the various forces acting therein. Additionally, hinged chamber doors 30*a*, 30*b*, 30*c*, and 30*d* are each pivotally mounted, for example, at 30*e*, and are powered by appropriate drive cylinders, such as 30*f*, for movement between full-line and phantom positions thereof illustrated for example in FIG. 4, to facilitate receiving batts into the chamber and then holding them in a neat, properly registered stack during the vertical lifting of the batts. As can be seen in FIG. 4, each chamber 30 has a chamber floor 31 for receiving the batts. The floor 31 has spaced apart floor openings 36. Each chamber has an inside wall 32, an outside wall 33 parallel to inside wall 32, and front wall and back walls 34 and 35, also in a parallel relation to each other, all of which project generally vertically upward from around chamber floor 31. Chamber floor 31 is at the same height above the production floor P as first surface 16, and chamber 30 has a ceiling 38, or other similar structure, at a predetermined distance above chamber floor 31, thereby forming a complete cover over chamber 30. Inside wall 32 extends from ceiling 38 down to a height above surface 16 to allow space 13, which is sufficient room for a collection of batts to pass therethrough when the doors 30*a*, 30*b*, 30*c*, and 30*d* are open.

As can be seen in FIGS. 2, 3 and 4, each chamber 30 has a plurality of horizontal lifting members 37 in a spaced relation to and in a normally recessed first position in floor openings 36. The members 37 will generally be smooth-surfaced to facilitate batt movement thereover. All lifting members 37 are joined at the inner side to a generally rectangular lifting frame 41, and lifting frame 41 is raisable to a second higher position from the first recessed position by a lifting power source 42, in the direction of Arrows D in FIGS. 3 and 5. Lifting power source 42 is securely anchored to ceiling 38 by an anchor bracket 43 and is similar in kind to transfer power source 23. As can be seen more clearly in FIG. 5, each of the floor openings 36 is surrounded by convex or curved edges 39. Curved edges 39 help provide a smooth surface immediately adjacent lifting members 37 for easy movement of the insulation batts thereon. Front wall 34 has a front wall aperture 44 immediately adjacent chamber floor 31, and on the outside of front wall 34 and extending from aperture 44 is a snout 45. A container K, generally of the bag type (FIG. 6*k*) may be placed around snout 45 for receiving the compressed insulation batts. Immediately opposite front wall aperture 44 in the back wall 35 is a back wall aperture 46. A ram 47 connected to another power source through back wall aperture 46 sits immediately inside back wall 35 and rides just above chamber floor 31. The function of ram 47 will be discussed below.

As can be seen in FIGS. 1 and 3, immediately outside of outer wall 33 are a plurality of holding fingers 51. Fingers 51 are flat, elongated slats and are connected to finger support frame 52, a generally "C"-shaped, flat frame, and are movable in a generally horizontal direction as shown by Arrow E (FIG. 3) through sidewall aperture 54 by a finger moving power source 53. FIG. 4 shows that fingers 51 are in an alternately spaced relationship with members 37 so that fingers 51 will not contact members 37 during this movement. Finger moving power source 53 is of a similar nature as the first two power sources, 23 and 42, mentioned herein. Finger-moving power source 53 is securely fastened atop a stabilizing framework 55, which is at a predetermined height above chamber floor 31. Framework 55 is at a preselected distance away from outside wall 33 to allow fingers 51 to be extended inside chamber 30 and inserted under a collection of batts that have by then been raised by members 37, (as members 37 are moved from the full line positions to the phantom positions illustrated thereon in FIG. 5) or to be retracted from underneath the collection to allow successive collections to be upraised or the full collection of batts to be compressed.

Extending from orifice 61 in ceiling 38 is compression plate 62 (FIG. 3). Compression plate 62 is a horizontally extending plate of approximately the same areal dimensions as insulation batt 10, and is forcibly powered as shown by Arrow F from a first normal height to a second lower height by a plate drive power means 66 as is shown respectively in full line and phantom line positions therefor in FIG. 5. Plate drive power source 66 is a similar type of power source to power source 23 as has been previously described. The second height (phantom lines) is at a predetermined height immediately above ram 47 and chamber floor 31 and plate 62 compresses all insulation batts 10 inside chamber 30 against chamber floor 31 into a tight compact unit upon reaching this position. Compression plate 62 has a pair of traveler rods 67 which extend through ceiling apertures 68 in a parallel manner to guide compression plate 62 up and down.

Figure 5:
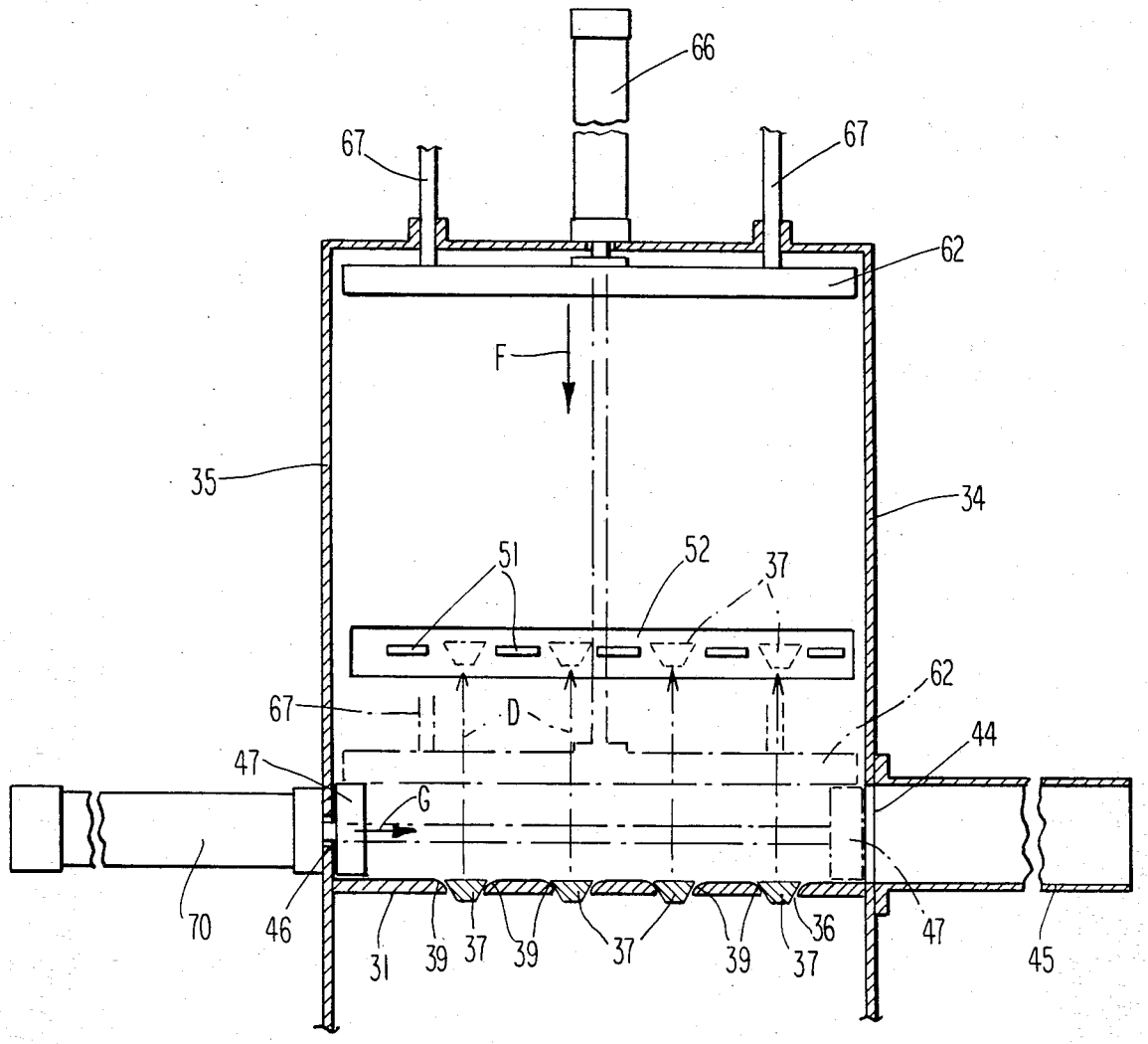
FIG. 5 is a sectional view taken along lines V—V of FIG. 4.

Finally, as can be seen clearly from FIG. 5, a ram power source 70 is connected adjacent back wall 35 to ram 47. This power source 70 is very similar to the previous power sources as described herein, and serves to push the compressed insulation batts out of chamber 30 in the direction of Arrow G on FIG. 5 and through snout 45 into a waiting container K. This is also illustrated by Arrows G' in FIG. 1.

Operations Cycle

Figure 6A:
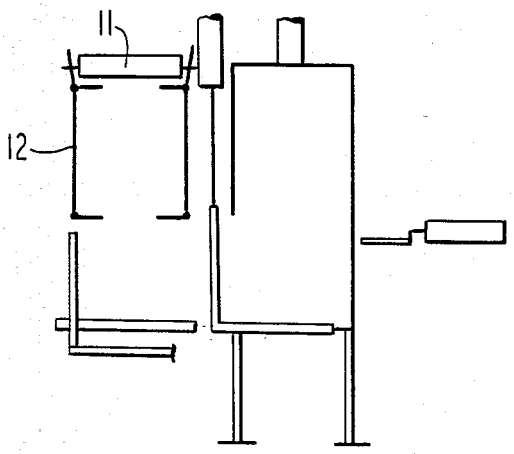
FIGS. 6*a* through 6*s* are a series of schematic views illustrating the manner in which insulation batts are collected, stacked, transferred, compressed and packaged by the automatic packaging module of the present invention.
Figure 6B:
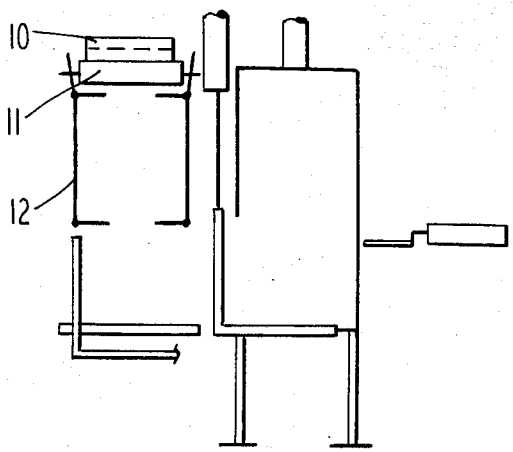
Figure 6C:
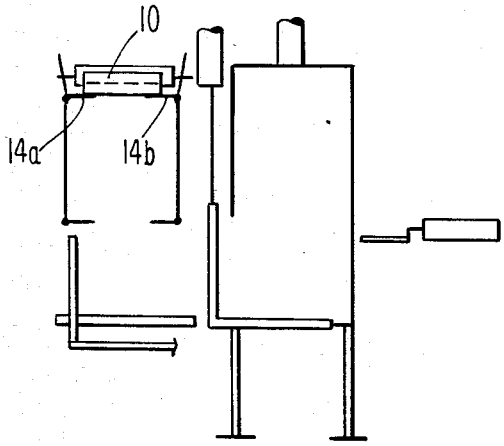
Figure 6D:
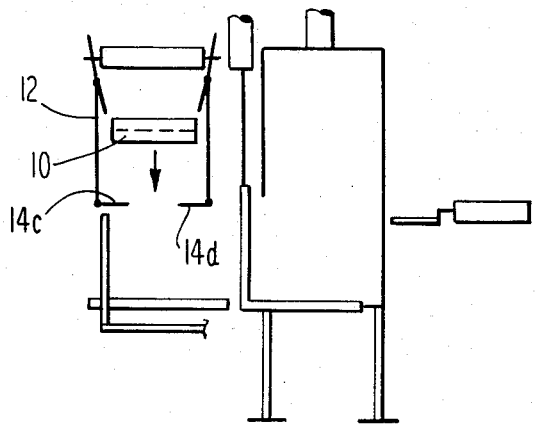
Figure 6E:
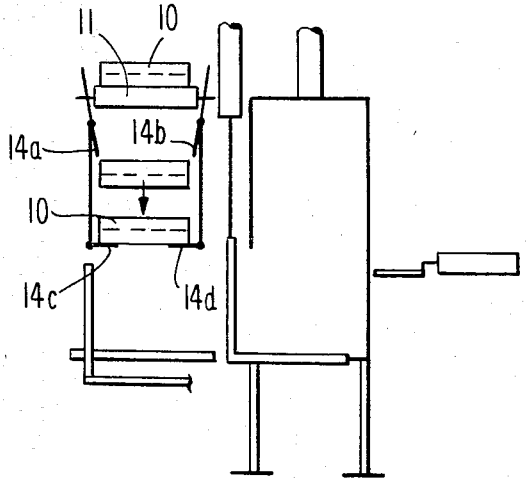
Figure 6F:
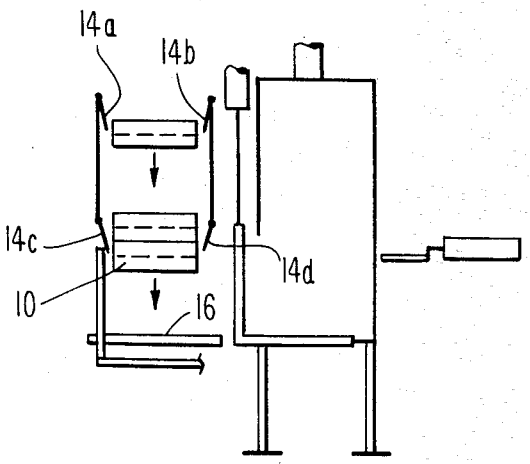
Figure 6M:
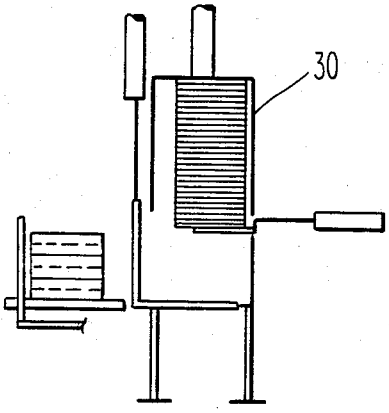
Figure 6N:
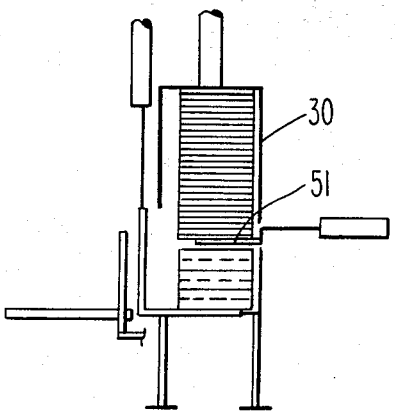
Figure 6O:
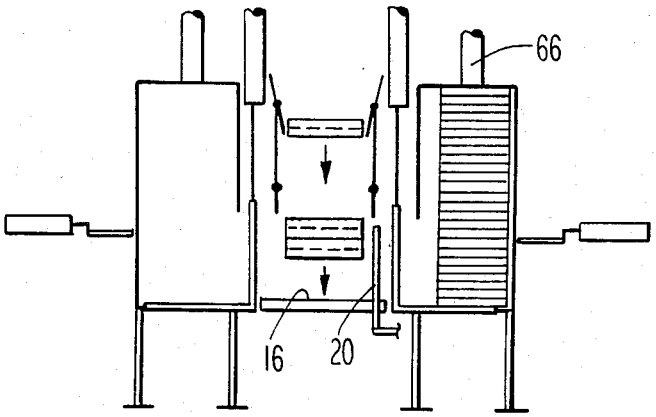
Figure 6P:
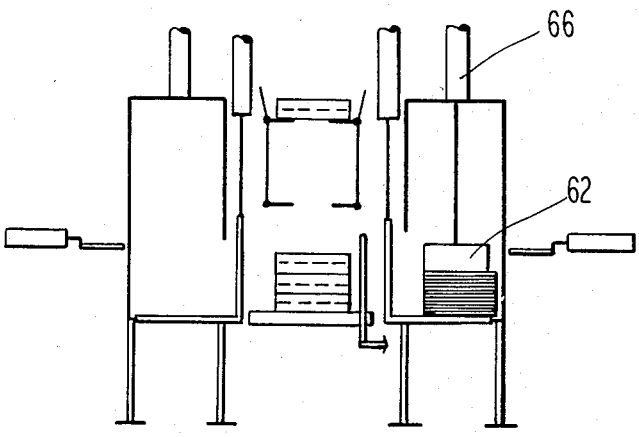
Figure 6Q:
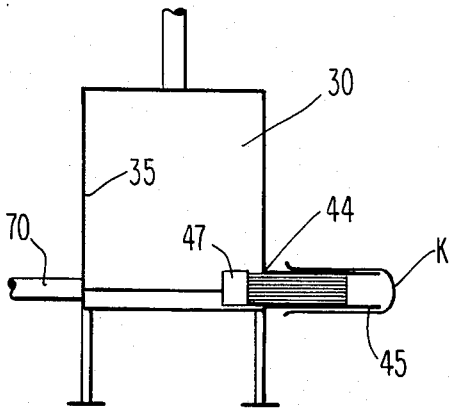
Figure 6R:
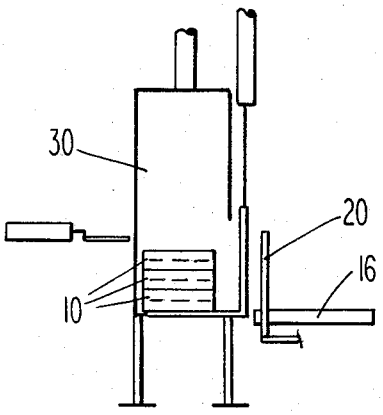
Figure 6S:
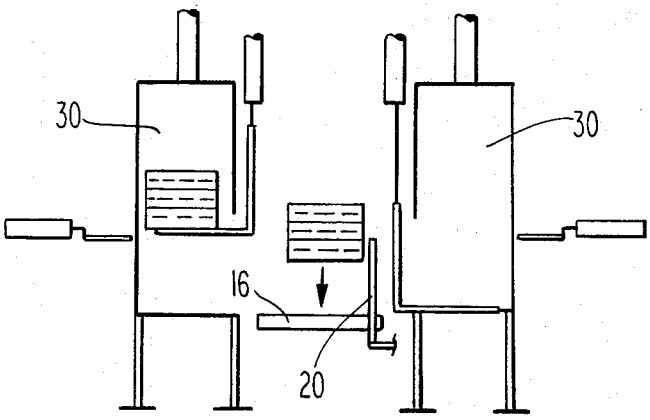

FIGS. 6*a* through 6*s* show the individual steps that the present invention cycles go through to receive insulation batts from the conveyor at the production line and to package those batts into a container. The complete cycle will be described by referring to the single chamber in operation, but it is to be understood that there are a pair of batt packing chambers 30 at all times, as is shown clearly in FIG. 6*s*.

As is shown in FIG. 6*a*, the upwardly inclined conveyor 11 of the production line is disposed, for conveying batts up to the top tray of the two-stage collection tray 12 (or to a single stage tray, if desired (not shown) if unfolded batts are being conveyed). As the batts proceed up the conveyor, they may be counted by passing counting photocell 9 (FIG. 1). Alternatively, they may have their size and weight determined by some suitable means (not shown). Preferably, the collection tray 12 will collect the insulation batts 10 as they proceed from the production line. In FIG. 6*b*, a folded batt 10 is illustrated just prior to it being delivered from the conveyor 11 into the top tray of the two-stage collection tray 12. In FIG. 6*c*, the folded batt 10 is shown disposed on the tray doors 14*a* and 14*b*, where the batt 10 is momentarily held on those doors.

With regard to FIG. 6*d*, upon actuation of appropriate control cylinders (not shown), the trap doors 14*a* and 14*b* have been opened to allow the batt 10 to drop onto the lower doors 14*c*and 14*d*, which together comprise the lower stage of the two-stage collection tray 12. With reference to FIG. 6*e*, a second batt is shown having been dropped by the opened doors 14*a* and 14*b* onto the first batt, while a third folded batt is approaching the top tray stage, being delivered thereto by the conveyor 11. Then, the doors 14*a* and 14*b* close to receive the third batt 10 (not shown), and thereafter all tray doors 14*a*, 14*b*, 14*c*, and 14*d* are simultaneously opened (reference FIG. 6*f*), by appropriate actuation of drive cylinders, thereby dropping all three batts 10, simultaneously, onto the first surface 16. It will be noted that, most preferably, the openings of the tray doors are computer controlled, for precise sequence of operations, as are desired. Generally, all other doors, movements, cylinder actuations and the like are all also, preferably computer controlled for the precise and most efficient timing of the sequences of operations described herein.

With reference now to FIG. 6*g*, it will be seen that three folded batts 10 are disposed on the surface 16, for engagement by fenders of batt transfer device 20. The batt transfer device 20 is appropriately actuated by means of the desired signal, again, preferably computer controlled, and engages the batts 10 transferring them to a rightward position as viewed in FIG. 6*h* inside the chamber 30. With particular regard to FIG. 6*i*, it will be seen that the transfer device 20 then automatically returns to its original position, by appropriate reversal of its power means. At this point, door cylinders 30*f* (FIG. 1) have been actuated, to close previously opened doors 30*b*, 30*d* (not shown in the sequences of FIG. 6), and then lifting cylinder 42 is actuated to lift frame and lift memebers 37, thereby lifting the stack of three double or folded batts 10 upwardly as shown in FIG. 6*i*. Then, as shown in FIG. 6*j*, the power source 53 moves holding fingers 51 inwardly through the chamber wall, to engage beneath the stack of batts 10 in chamber 30, while another stack of three batts 10 has been deposited on surface 16, and the chamber 42 has allowed the lift members 37 to return to their lower position. Then, the chamber doors 30*b*, 30*d*, are opened (not shown in the sequence of FIG. 6) and the batt transfer device or shuttle 20 moves the second set of three batts into the chamber 30, beneath the first set of batts therein, as is seen in FIG. 6*k*. The doors 30*b* and 30*d* are then closed, the cylinder 53 is reverse-actuated, causing withdrawal of the holding fingers 51, leaving the originally deposited batts in the chamber 30 to drop down onto the more recently positioned pile of batts in the chamber 30, and the lifting cylinder 42 is again actuated to cause the lifting members 37 to again lift all of the batts in the chamber 30 upwardly, as is seen in FIG. 61.

With reference to FIG. 6*m*, this sequence continues until the insulation batts in the chamber 30 become somewhat compressed, and the chamber 30 becomes substantially completely filled with insulation batts, as is illustrated in FIG. 6*n*. It will, of course, be apparent that after the last group of batts 10 is delivered into the chamber 30, the lift cylinder is not actuated for lifting this last group of batts upwardly. Then, after a predetermined number of batts is in the chamber 30, and in accordance with a proper signal, the lifting fingers 51 are withdrawn, allowing all collections of batts to become one large stack (see FIG. 6*o*). At this point, another signal (not shown) is sent to the plate drive source 66 and compression plate 62 is powered downward to compress all of the insulation batts into a smaller unit. At this point, an end-of-cycle signal (not shown) is received by ram power source 70 and ram 47 proceeds from its position adjacent the back wall 35 and pushes the compressed insulation batts through the front wall aperture 44 and snout 45 into a waiting container K, as can be seen from FIG. 6*q*. Meanwhile, the batt transfer device or shuttle 20 has now assumed a position at rest on the right side of the batt receiving surface 16, awaiting the deposit of batts on the surface 16, so that it will be engaging batts from its opposite side, for filling the left-most chamber, as is illustrated in FIGS. 6*o* and 6*p*.

As can be seen from FIGS. 6*r* and 6*s*, while this compression cycle is taking place, batts being delivered onto the surface 16 are transferred into the left-most chamber 30 and the above-described cycle of operations is repeated. In this way, the sequence and speed of the production line is never interrupted.

Obviously, many modifications and variations of the present invention are possible in light of the above teachings, and, it is therefore understood that within the scope of the disclosed invented concepts, the invention may be practiced otherwise than specifically disclosed. One alternative method can be illustrated by referring to the illustrations of FIGS. 6*a* through 6*s*. When a first collection of batts 10 is transferred into a chamber 30, as is shown in FIG. 6*h*, batt transfer device 20 can be caused to remain in the transfer position shown (by appropriate computer control means not shown), while a second collection of batts is deposited on surface 16. At this point, the device 20, already in the right-most position with respect to the deposit surface 16, can be caused to move leftward after batts have been deposited onto the surface 16, thereby moving that group of batts into the opposite chamber 30 (not shown). In such a manner of operation, the device 20 would be working as a batt transfer device with each lateral movement, first engaging batts from one side and then from the other, in true shuttle fashion. In this method of operation, a pair of chambers 30 could undergo filling substantially simultaneously. It will be noted, that with such an alternative manner of operation, there would not normally be the delay caused by the collection of batts in the collection tray 12, and that therefore a collecting device such as the two-stage collection tray 12 may be dispensed with, with batts being delivered directly from the conveyor onto the surface 16, one at a time, and with the batt transfer device 20 engaging only a single batt at a time for movement into one of the chambers 30, or the other.

What I claim is:

1. In an improved apparatus for removing insulation batts from a delivery zone of a production line or the like by collecting and stacking the batts, transferring the stacks, compressing the stacks into a smaller volume and moving the smaller volume to a container, the improvement comprising:

(a) a first surface located below the delivery zone for receiving batts therefrom;

(b) reciprocating transfer means for engaging batts and moving collections of batts generally horizontally from and to opposite lateral sides of said first surface; and (c) a plurality of packing chambers located immediately adjacent said first surface and on opposite lateral sides thereof, each said chamber having (i) at its base, a generally horizontally extending floor, (ii) lifting means for receiving the collection of batts at a first position from said transfer means and lifting the collection from the first position to a second higher position, (iii) retaining means at said higher position for holding the collection in said second position, (iv) compression means for forcibly combining the collections into a unit of compressed insulation batts, and (v) container filling means for moving the unit from said chamber into a container.

2. In an improved apparatus as in claim 1 wherein said reciprocating transfer means comprises a batt transfer device having generally vertically disposed batt engaging means for contacting the batts that include guides projecting through a plurality of laterally running slots in said first surface, said guides being connected to a transfer power means for moving said guides.

3. In an improved apparatus as in claim 1 wherein each said chamber has a stationary chamber floor and wherein said lifting means comprises a plurality of generally horizontal lifting members in a normally recessed relationship with openings in said chamber floor that comprise said first position but are movable from said openings upon lifting to said second position and a lifting power means for guided raising and lowering of said lifting members.

4. In an improved apparatus as in claim 1 wherein each said chamber has generally vertically disposed wall surfaces extending around said floor, and wherein said retaining means comprise holding fingers extendingly disposed through an aperture in a said wall into said chamber in a horizontal direction at said higher position to removably retain the collection of batts while said lifting members lower to said first position, said fingers being connected to a finger-moving power means for back and forth movement.

5. In an apparatus as in claim 1 wherein said compression means comprises a vertically movable horizontally disposed plate mounted for movement from the upper end of said chamber with plate drive power source connected thereto for forcing said plate into the collection of batts.

6. In an improved apparatus as in claim 1 wherein said container filling means comprises:

(a) a snout extending outwardly from an aperture in said chamber wall adjacent said floor comprising means for removably receiving a container applied thereto;

(b) a horizontally extendable ram inwardly of and adjacent to an aperture in said chamber wall and opposite of said wall having the snout and aperture; and (c) ram power means for moving said ram in a pushing relation to the unit from said back wall aperture, through said aperture and snout and into the container.

7. In an improved apparatus as in claim 1 wherein said batt engaging means comprise a plurality of batt contacting fenders connected to said guides at a point above said first surface at opposite sides thereof.

8. The apparatus of claim 1, including batt collection means of the tray type disposed above said first surface for receiving batts from said delivery zone; said collection means comprising a two-stage tray, with each tray stage including pivotally operable door means for discharging batts vertically therefrom.

9. In an improved apparatus for removing insulation batts from a delivery zone of a production line or the like by collecting and stacking the batts, transferring the stacks, compressing the stacks into a smaller volume and moving the smaller volume to a container, the improvement comprising:

(a) a first surface located below the delivery zone for receiving batts therefrom;

(b) reciprocating transfer means for engaging batts and moving collections of batts generally horizontally from said first surface;

(c) a packing chamber located immediately adjacent said first surface for receiving the collections of batts and having (i) at its base, a generally horizontally extending stationary floor, (ii) generally vertically disposed walls around said floor, (iii) lifting means for receiving the collection of batts at a first position from said transfer means and lifting the collection from the first position to a second, higher position, (iv) holding fingers extendingly disposed through an aperture in a said wall into said chamber in a horizontal direction at said higher position to removably retain the collection of batts while said lifting means lowers to said first position, said fingers being connected to a finger-moving power means, (v) compression means for forcibly combining the collections of batts into a unit of compressed insulation batts, and (vi) container filling means for moving the unit from said chamber into a container.

10. In an improved apparatus as in claim 9 wherein said lifting means comprises a plurality of generally horizontal lifting members in a normally recessed relationship with openings in said chamber floor that comprise said first position but are movable from said openings upon lifting to said second position, and a lifting power means for guided raising and lowering of said lifting members.

11. In an apparatus as in claim 9 wherein said compression means comprises a vertically movable horizontally disposed plate mounted for movement from the upper end of said chamber with a plate drive power source connected thereto for forcing said plate into the collection of batts.

12. In an improved apparatus as in claim 9 wherein said container filling means comprises:

(a) a snout extending outwardly from an aperture in said chamber wall adjacent said floor comprising means for removably receiving a container applied thereto;

(b) a horizontally extendable ram inwardly of and adjacent to an aperture in said chamber wall and opposite of said wall having the snout and aperture; and (c) ram power means for moving said ram in a pushing relation to the unit from said back wall aperture, through said aperture and snout and into the container.

13. In an improved apparatus for removing insulation batts from a delivery zone of a production line or the like by collecting and stacking the batts, transferring the stacks, compressing the stacks into a smaller volume and moving the smaller volume to a container, the improvement comprising:

(a) a first surface located below the delivery zone for receiving batts therefrom;

(b) a batt transfer device for engaging batts and moving collections of batts generally horizontally from and to opposite lateral sides of said first surface and having generally vertically disposed batt engaging means for contacting the batts that include guides projecting through a plurality of laterally running slots in said first surface, said guides being connected to a transfer power means for moving said guide;

(c) a plurality of packing chambers located immediately adjacent said first surface and on opposite lateral sides thereof, each said chamber having (i) at its base, a generally horizontally extending floor, (ii) a plurality of generally horizontal lifting members in a normally recessed relationship with openings in said chamber floor that comprise a first position for receiving the collection of batts from the batt transfer device at said first position but which are movable from said openings upon lifting to a second higher position, being powered to said second higher position by a lifting power means for guided raising and lowering of said lifting members, (iii) generally vertically disposed wall surfaces extending around said floor and holding fingers extendingly disposed through an aperture in a said wall into said chamber in a horizontal direction at said second higher position to removably retain the collection of batts while said lifting members lower to said first position, said fingers being connected to a finger-moving power means for back and forth movement, (iv) a vertically movable horizontally disposed plate mounted for movement from the upper end of said chamber with plate drive power source connected thereto for forcing said plate into the collection of batts against said chamber floor thereby comprising a smaller unit, and (v) a snout extending outwardly from an aperture in said chamber wall adjacent said floor comprising means for removably receiving a container applied thereto, a horizontally extendable ram inwardly of and adjacent to an aperture in said chamber wall and opposite of said wall having the snout and aperture, and ram power means for moving said ram in a pushing relation to the unit from said back wall aperture, through said aperture and snout and into the container.

14. A method for receiving a plurality of insulation batts from delivery zone of a production line or the like by collecting the batts into stacks, transferring the stacks into one of a plurality of bagging chambers, retaining the stacks while other stacks are transferred in, compressing all stacks and transferring the compressed unit of insulation batts into a container, comprising the steps of:

(a) collecting and stacking the batts on a first surface having opposite, lateral sides as said batts proceed off a production line;

(b) moving the collection of batts off of either lateral side of said first surface with a reciprocating motion directed horizontally across said first surface and into a first position in a first packing chamber;

(c) raising the collection of batts from said first position to a second higher position thereabove;

(d) extending holding fingers underneath the collection of batts to retain the collection in said second higher position;

(e) receiving successive collections of batts in said first position in said first chamber and raising said successive collections up to said second higher position;

(f) retracting and extending said holding fingers to retain the successive collections of batts in said second higher position;

(g) compressing the collections of batts in said chamber into a smaller volume;

(h) transferring a collection of batts by said batt transfer device into a second bagging chamber for stacking and compressing therein; and (i) removing the smaller volume of compressed batts from the inside of said first chamber into a waiting container.

15. A method as in claim 14 wherein said reciprocating motion is provided by a batt transfer device having vertical guides projecting from above said first surface and through laterally running slots in said first surface extending from said opposite sides thereof, and being connected to a transfer power source.

16. In an improved apparatus for removing insulation batts from a delivery zone of a production line or the like by collecting and stacking the batts, transferring the stacks, compressing the stacks into a smaller volume and moving the smaller volume to a container, the improvement comprising:

(a) a first surface located below the delivery zone for receiving batts therefrom;

(b) reciprocating transfer means for engaging batts and moving collections of batts generally horizontally from and to opposite lateral sides of said first surface; and (c) a packing chamber located immediately adjacent said first surface and to the side thereof, said chamber having (i) at its base, a generally horizontally extending floor, (ii) lifting means for receiving the collection of batts at a first position from said transfer means and lifting the collection from the first position to a second higher position, (iii) retaining means at said higher position for holding the collection in said second position, (iv) compression means for forcibly combining the collections into a unit of compressed insulation batts, and (v) container filling means for moving the unit from said chamber into a container.

17. In an improved apparatus for removing insulation batts from a delivery zone of a production line by collecting and stacking the batts, transferring the stacks, compressing the stacks into a smaller volume and moving the smaller volume to a container, the improvement comprising:

(a) a first surface located below the delivery zone for receiving batts therefrom;

(b) reciprocating transfer means for engaging batts and moving collections of batts generally horizontally from said first surface;

(c) a plurality of packing chambers located immediately adjacent said first surface and on opposite sides thereof for receiving the collections of batts and each having (i) at its base, a generally horizontally extending stationary floor, (ii) generally vertically disposed walls around said floor, (iii) lifting means for receiving the collection of batts at a first position from said transfer means and lifting the collection from the first position to a second, higher position, (iv) holding fingers extendingly disposed through an aperture in a said wall into said chamber in a horizontal direction at said higher position to removably retain the collection of batts while said lifting means lowers to said first position, said fingers being connected to a finger-moving power means, (v) compression means for forcibly combining the collections of batts into a unit of compressed insulation batts, and (vi) container filling means for moving the unit from said chamber into a container.

* * * * *